United States Patent [19]

Lace

[11] 4,010,439

[45] Mar. 1, 1977

[54] PLANETARY POTENTIOMETER ASSEMBLY

[75] Inventor: Melvin Arthur Lace, Prospect Heights, Ill.

[73] Assignee: Motorola, Inc., Schaumburg, Ill.

[22] Filed: Oct. 31, 1975

[21] Appl. No.: 627,643

[52] U.S. Cl. ..... 338/125; 338/130; 338/157

[51] Int. Cl.[2] ..... H01C 10/20; H01C 10/28

[58] Field of Search ..... 338/157, 158, 125, 126, 338/127, 92, 97, 128, 130

[56] References Cited

UNITED STATES PATENTS

| | | | |
|---|---|---|---|
| 1,883,098 | 10/1932 | Templeton | 338/157 X |
| 3,531,754 | 9/1970 | Geese | 338/157 |

FOREIGN PATENTS OR APPLICATIONS

| | | | |
|---|---|---|---|
| 346,085 | 4/1931 | United Kingdom | 338/157 |

*Primary Examiner*—Arthur T. Grimley
*Assistant Examiner*—David A. Tone
*Attorney, Agent, or Firm*—Margaret Marsh Parker; James W. Gillman

[57] ABSTRACT

Multiple resistance elements are mounted in parallel pairs around the inside curved wall of the assembly housing. Multiple cylindrical contacts in a planetary arrangement are rotated by a friction drive surface mounted on the control shaft. Each cylindrical contact rolls on one pair of resistance elements. The cylindrical contacts, by being movable shunts between the parallel strips, provide ganged multiple potentiometer or rheostat capability. No terminal is connected to any moving part. The diameter of the drive surface and the diameter of the cylindrical contacts determine the possible number of resistance elements per assembly. Shaft rotation for full range variation, thus vernier capability, is determined by the ratio of the drive surface diameter to the inside diameter of the housing.

7 Claims, 8 Drawing Figures

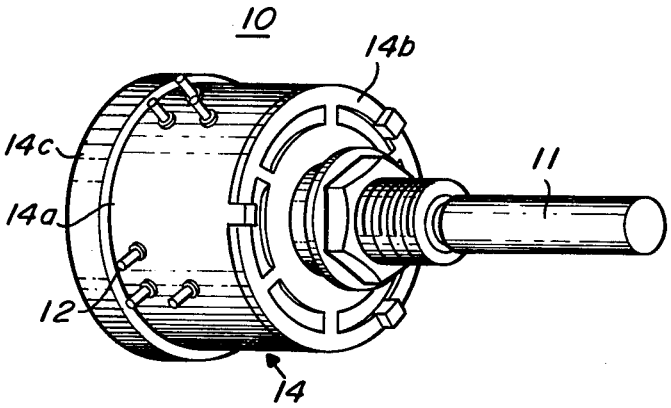
Fig. 1
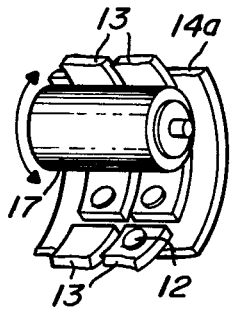
Fig. 3
Fig. 5C
Fig 5D
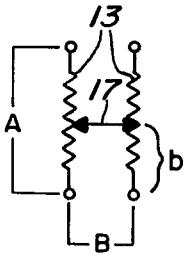
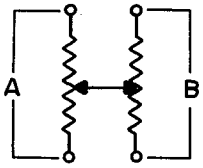
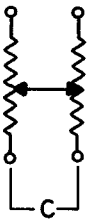
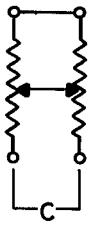
Fig 5A
Fig 5B
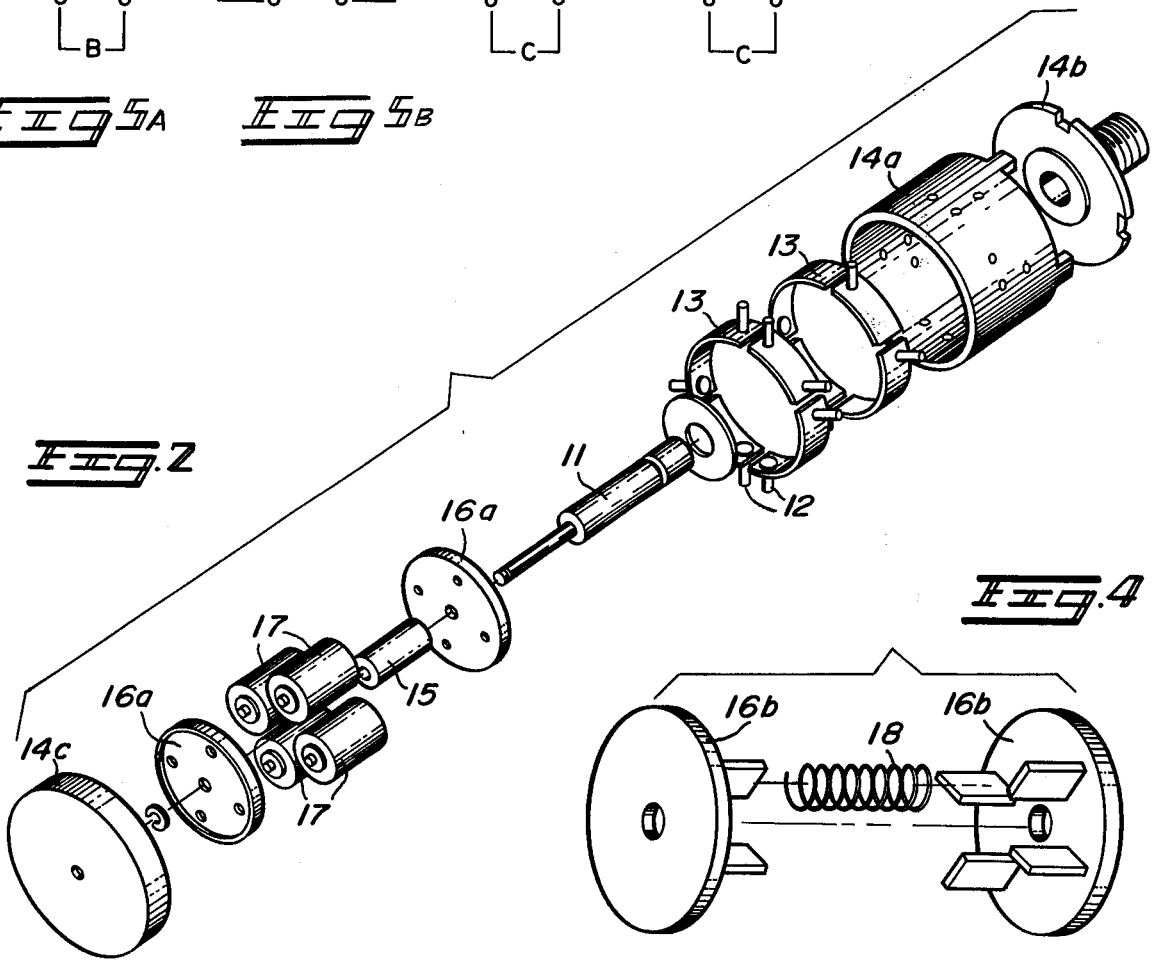
Fig. 2
Fig. 4

PLANETARY POTENTIOMETER ASSEMBLY

BACKGROUND OF THE INVENTION

This invention relates broadly to ganged, variable resistance elements and specifically to multiple elements within a small area, also having vernier capability.

Very early in the history of communications devices it became evident that a need existed for multiple controls which could be adjusted simultaneously. Many solutions have been developed, possibly the most satisfactory being the most obvious, i.e., using a common shaft to turn the rotors of several axially aligned but individual controls. With the move toward microelectronics has come a demand for all components to be reduced in size without affecting other characteristics. The development of four-channel sound has given new impetus to the search for smaller multiple controls for adjusting tone or volume of the individual channels simultaneously as desired.

SUMMARY OF THE INVENTION

It is therefore an object of this invention to provide multiple ganged variable resistance units in a relatively small area.

It is an additional object to provide vernier capability in a multiple control.

In the present invention, these objectives are achieved by the use of a planetary arrangement of cylindrical contact elements which are supported between two spaced apart insulating members mounted on a single control shaft. The contact elements are spaced around the shaft and are driven by a friction drive surface affixed to the shaft between the insulating support members. Each resistance is made up of two parallel strips of resistance material mounted on the inside of the curved wall of the housing. Electrical contact with the resistance material is made through the curved housing wall. No terminals are connected to any moving part. As the cylindrical contact is driven by the friction surface, it shunts across the two strips, thus increasing or decreasing the effective resistance between the terminals. The ratio of the diameter of the friction drive portion of the shaft to the inside diameter of the housing determines approximately the degrees of rotation of the shaft for full range resistance variation.

BRIEF DESCRIPTION OF THE DRAWING

FIG. 1 is a perspective view of a complete multiple control according to a preferred embodiment of the invention.

FIG. 2 is an exploded view of the control of FIG. 1.

FIG. 3 is a perspective view of a section of the interior of the control of FIGS. 1 and 2.

FIG. 4 is an exploded partial perspective view of another embodiment of the contact for the control of FIGS. 1–3.

FIG. 5 is a set of wiring diagrams for various applications of the invention.

DETAILED DESCRIPTION OF THE INVENTION

The invention will be best understood by reference to the accompanying drawing in which like reference numerals designate like parts in the various figures. FIG. 1 is an overall view of an embodiment of the invention generally designated as reference numeral 10, wherein turning shaft 11 changes either the resistances or moves voltage taps in the several circuits of an electronic apparatus (not shown). Terminals 12 are connected to the ends of the resistance elements 13 (FIGS. 2 and 3) and pass through the curved wall **14*a* of the housing 14, the wall preferably being made of a sturdy insulating material. The bottom 14*c* of the housing may be of any suitable material but should preferably seal the contents from the environment and support the end of the shaft 11. The top 14*b* of the housing is of standard potentiometer construction. The entire housing can be made of metal, but, provision must then be made to insulate the terminals from the housing. In either case, slight resilience of the curved housing wall is desirable for best contact between the rolling contacts and the resistance elements. FIG. 2 is an exploded view showing the parts of the invention in detail. A four-unit control is illustrated but no such limitation is implied or should be construed. Around a narrowed portion of the shaft 11 is tightly affixed a friction drive surface 15 and at each end of the drive surface an insulating disc 16*a* is mounted on the shaft in a loose fit. Supported by the discs 16*a* and spaced evenly around the shaft 11 are a number of cylindrical contacts 17. If one of the contacts 17 is to act as a shunt it will preferably be made of a non-oxidizing metal such as brass. If, as described below, electrical contact is not desirable, any suitable insulating material may be used. The resistance elements 13 may be of any material having the desired characteristics, a preferred material being a mylar ribbon with a resistance coating, which is highly tolerant flexing. A spacific example is RESISTOFILM made by New England Instrument Company. For simplicity in the drawing, the elements 13 are shown as rectangular. However, as is known in the art, the shape would depend on the resistance characteristic desired. some form of detent or shaft rotation limiting device would normally be required, but since such devices are well known in the art and form no part of the novelty of the invention, they are omitted from the drawing in the interest of clarity. In FIG. 3 is shown a portion of the interior of the curved wall 14*a* of the housing 14. Shown in this view are parts of four of the resistance elements 13 which make up two of the four ganged control units in this embodiment, along with the conductive cylindrical contact 17 of one control unit. Three terminals 12 are shown for each control unit but two or four may be used, depending on the application of the controls according to the invention. As the shaft 11 is rotated, each cylindrical contact 17 will constitute a moving shunt across the two resistance elements 13** of one control unit. Thus, depending on the wiring, as will be described more fully below, a rheostat or potentiometer function is provided.

In FIG. 4 another embodiment of the contact portion is shown wherein each of the cylindrical contacts is a coiled spring 18 (one shown). The insulating discs **16*b* have projections which support the springs. Since the coils are under some compression when installed, a slight wiping action is provided as the control shaft is turned. Under certain operating conditions this may be a desirable or even necessary feature. The resistance elements 13 of FIG. 3 would be used for this embodiment. FIG. 5 includes four possible wiring diagrams for any one of the ganged controls, FIG. 5*a* providing potentiometer capability wherein A represents one pair of terminals and B represents another pair of terminals. FIGS. 5*c* and 5*d* providing rheostat or variable resistance capability. The circuit of FIG. 5*b*** might be desirable in some applications. The circuit of FIG. 5*a* is a typical potentiometer arrangement as far as the remainder of the circuit is concerned, except that the portion marked (b) of one of the resistance elements 13 is included in the output circuit. It should be noted here that all values of resistance are within the scope of the invention including values down to essentially zero for any individual resistance strip. FIGS. 5*c* and 5*d* are essentially identical rheostats but the end connection of FIG. 5*d* might be advantageous if the cylindrical contact should momentarily be inadvertently separated from the resistance elements, as by physical shock.

From the above, it is clear that the invention teaches a multiple, ganged variable resistor or potentiometer within a space as small or smaller than that usually occupied by a single equivalent unit. A second feature is that there is no moving contact which must be connected to a non-moving terminal. Another feature is that the ratio of the inside diameter of the housing to the diameter of the friction drive portion of the shaft determines the ratio of the degrees of rotation of the shaft to degrees of arc of one pair of resistance elements traversed by one contact means, i.e., $$\frac{\text{diameter of drive surface}}{\text{diameter of housing}} = \frac{\text{degrees of arc (of element)}}{\text{degrees of shaft rotation.}}$$

Thus, a vernier capability is obtained which is somewhat dependent on the number of ganged control units. For four units, the optimal design provides approximately 250° rotation of the shaft for a 70° arc element. For a single control unit in one housing having one conductive cylindrical contact and one non-conductive contact and a small diameter drive surface, the resistance element could cover approximately 330° of arc and shaft rotation could be as much as eight times that. It is also obvious that electrical contacts or taps may be made available at any point along any of the resistance elements by means of additional terminals.

I claim:

1. A multiple, ganged variable resistance assembly having a single cyclindrical housing and comprising:

a multiplicity of resistance elements in two circumferential lines around the interior of the curved housing wall and forming substantially parallel pairs;

terminal means penetrating the housing wall for making contact with the resistance elements;

a shaft rotatably and axially mounted on the housing and extending through the top thereof;

an insulating, resilient, friction drive surface surrounding and fixably mounted on a portion of the shaft within the housing;

a multiplicity of substantially cylindrical members equally spaced around and with axes parallel to the shaft axis, the cylindrical members being electrically conductive, each member being arranged to contact and be driven by the friction drive surface on the shaft and being dimensioned to contact one pair of resistance elements in any rotational position of the shaft; and two spaced apart insulating members mounted on the shaft adjacent the ends of the friction drive surface for supporting the cylindrical members.

2. An assembly according to claim 1 wherein the cylindrical member are solid cylinders of a nonoxidizing, electrically conductive material.

3. An assembly according to claim 1 wherein the cylindrical members are helical springs of a nonoxidizing, electrically conductive material.

4. An assembly according to claim 1 wherein the sides of each pair of resistance elements are parallel.

5. A multiple, ganged potentiometer assembly comprising:

a cylindrical housing;

a rotatable shaft means coaxially mounted in the housing;

a resilient, insulating drive surface fixedly mounted on the shaft means;

a multiplicity of resistance elements mounted in parallel pairs around the inner curved wall of the housing; and at least two electrically conductive cylindrical elements supported by the shaft means and positioned for being driven by contact with the drive surface and for providing a movable shunt across each pair of resistance elements.

6. A potentiometer assembly according to claim 5 wherein the curved wall of the housing is non-conductive and further including terminals mounted on the curved wall for providing electrical connection capability for the resistance elements.

7. A potentiometer assembly according to claim 5 wherein the shaft means includes insulating support means mounted adjacent the drive surface for supporting the cylindrical elements.

* * * * *